US006116984A

United States Patent [19]

Munoz et al.

[11] Patent Number: 6,116,984

[45] Date of Patent: Sep. 12, 2000

[54] POP-OUT TOY

[76] Inventors: Armando Munoz; Bonnie Munoz, both of 6006 Pine Canyon Dr., Bakersfield, Calif. 93313

[21] Appl. No.: 09/193,811

[22] Filed: Nov. 17, 1998

[51] Int. Cl.[7] ..... A63H 13/16; A63H 31/00; A63J 19/00; F16H 19/04

[52] U.S. Cl. ..... 446/310; 446/331; 446/366; 446/489; 74/109

[58] Field of Search ..... 446/308, 309, 446/310, 331, 366, 73, 489; 74/109, 110

[56] References Cited

U.S. PATENT DOCUMENTS

| | | | |
|---|---|---|---|
| 396,221 | 1/1889 | Morrow . | |
| 769,935 | 9/1904 | Brom . | |
| 1,243,380 | 10/1917 | Berger . | |
| 2,003,765 | 6/1935 | Wilden . | |
| 3,918,249 | 11/1975 | Masuyama | 58/12 |
| 5,713,778 | 2/1998 | Radosevich | 446/304 |

*Primary Examiner*—Kien T. Nguyen
*Assistant Examiner*—Kevin Hughes
*Attorney, Agent, or Firm*—Goldstein & Canino

[57] ABSTRACT

A pop-out toy including a housing with an opening through a central portion thereof. A bottom wall of the housing has a gear mounted on a rod extending upwardly from the inner surface interiorly thereof. A figurine is provided and is mounted on a platform positioned within the opening in the housing. The platform is secured to a support rod extending rearwardly therefrom interiorly of the housing. The support rod has teeth extending along a side edge thereof. The teeth engage an upper portion of the gear. A release mechanism is provided that is comprised of a handle extending inwardly of the housing interiorly thereof. The handle has teeth disposed along a side edge thereof. The teeth engage a lower portion of the gear.

4 Claims, 2 Drawing Sheets

FIG 3
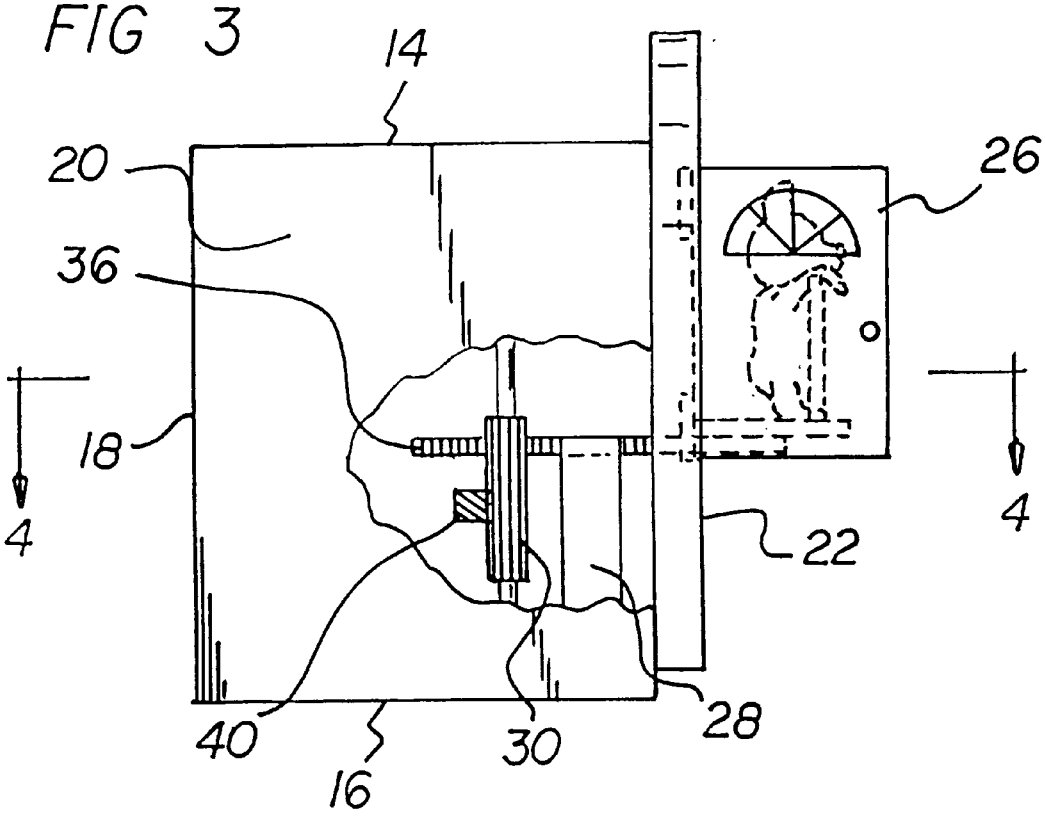
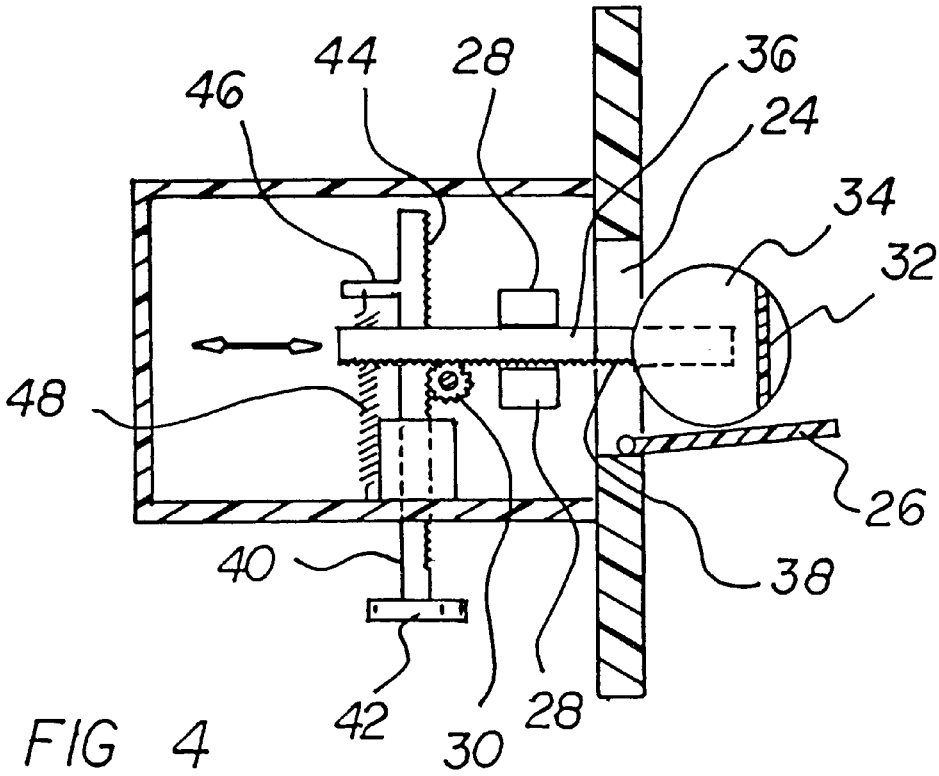
FIG 4

POP-OUT TOY

BACKGROUND OF THE INVENTION

1. Field of the Invention

The present invention relates to a pop-out toy and more particularly pertains to popping a figure out of a doorway via manual operation with a pop-out toy.

2. Description of the Prior Art

The use of toys is known in the prior art. More specifically, toys heretofore devised and utilized for the purpose of providing amusement are known to consist basically of familiar, expected and obvious structural configurations, notwithstanding the myriad of designs encompassed by the crowded prior art which have been developed for the fulfillment of countless objectives and requirements.

By way of example, U.S. Pat. No. 396,221 to Morrow; U.S. Pat. No. 5,069,650 to Lehmann; U.S. Pat. No. 4,323,238 to Jernstrom; and U.S. Pat. No. 4,798,555 to Schaub.

While these devices fulfill their respective, particular objective and requirements, the aforementioned patents do not describe a pop-out toy for popping a figure out of a doorway via manual operation.

In this respect, the pop-out toy according to the present invention substantially departs from the conventional concepts and designs of the prior art, and in doing so provides an apparatus primarily developed for the purpose of popping a figure out of a doorway via manual operation.

Therefore, it can be appreciated that there exists a continuing need for new and improved pop-out toy which can be used for popping a figure out of a doorway via manual operation. In this regard, the present invention substantially fulfills this need.

SUMMARY OF THE INVENTION

In the view of the foregoing disadvantages inherent in the known types of toys now present in the prior art, the present invention provides an improved pop-out toy. As such, the general purpose of the present invention, which will be described subsequently in greater detail, is to provide a new and improved pop-out toy and method which has all the advantages of the prior art and none of the disadvantages.

To attain this, the present invention essentially comprises a housing having a generally rectangular configuration. The housing is defined by a top wall, a bottom wall, a rear wall, opposed side walls, and an enlarged front wall. The front wall has a width about twice as great as a width of the rear wall. The front wall has an opening through a central portion thereof. The opening has a door pivotally disposed therein. The bottom wall has a pair of support posts extending upwardly from an inner surface interiorly of the housing. The bottom wall has a gear mounted on a rod extending upwardly from the inner surface interiorly of the housing adjacent to the pair of support posts. A figurine is provided and is mounted on a platform positioned within the opening in the front wall of the housing. The platform is secured to a support rod extending rearwardly therefrom interiorly of the housing. The support rod extends between the pair of support posts. The support rod has teeth extending along a side edge thereof. The teeth engage an upper portion of the gear. A release mechanism is provided that is comprised of a handle extending inwardly of one of the opposed side walls of the housing interiorly thereof. The handle has a manipulation knob disposed on an outer end thereof. The handle has teeth disposed along a side edge thereof. The teeth engage a lower portion of the gear. An inner portion of the handle has a post extending rearwardly therefrom. The post has a spring secured thereto. A free end of the spring secures to the side wall where the handle extended through into the housing. The spring biases the handle outwardly with respect to the housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pop-out toy which has all the advantages of the prior art toys and none of the disadvantages.

It is another object of the present invention to provide a new and improved pop-out toy which may be easily and efficiently manufactured and marketed.

It is a further object of the present invention to provide a new and improved pop-out toy which is of durable and reliable construction.

An even further object of the present invention is to provide a new and improved pop-out toy which is susceptible of a low cost of manufacture with regard to both materials and labor, and which accordingly is then susceptible of low prices of sale to the consuming public, thereby making such a pop-out toy economically available to the buying public.

Even still another object of the present invention is to provide a new and improved pop-out toy for popping a figure out of a doorway via manual operation.

Lastly, it is an object of the present invention to provide a new and improved pop-out toy including a housing with an opening through a central portion thereof. A bottom wall of the housing has a gear mounted on a rod extending upwardly from the inner surface interiorly thereof. A figurine is provided and is mounted on a platform positioned within the opening in the housing. The platform is secured to a support rod extending rearwardly therefrom interiorly of the housing. The support rod has teeth extending along a side edge thereof. The teeth engage an upper portion of the gear. A release mechanism is provided that is comprised of a handle extending inwardly of the housing interiorly thereof. The handle has teeth disposed along a side edge thereof. The teeth engage a lower portion of the gear.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is side view of the present invention as taken along line 3—3 of FIG. 2.

FIG. 4 is a cross-sectional view of the present invention as taken along line 4—4 of FIG. 3.

The same reference numerals refer to the same parts through the various figures.

DESCRIPTION OF THE PREFERRED EMBODIMENT

Figure 1:
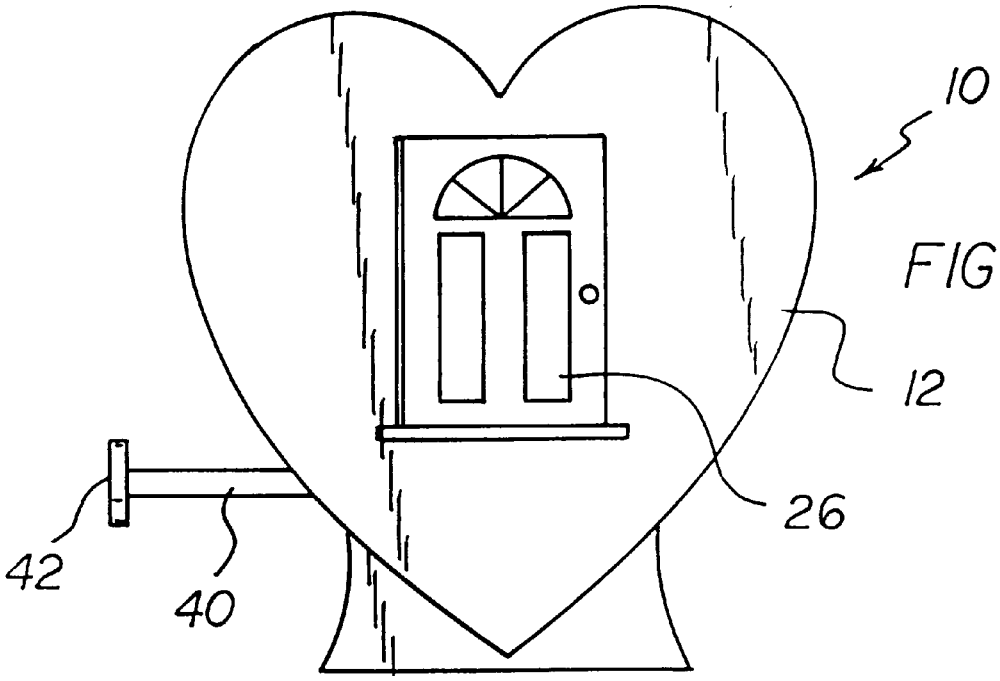
FIG. 1 is a perspective view of the preferred embodiment of the pop-out toy constructed in accordance with the principles of the present invention.
Figure 2:
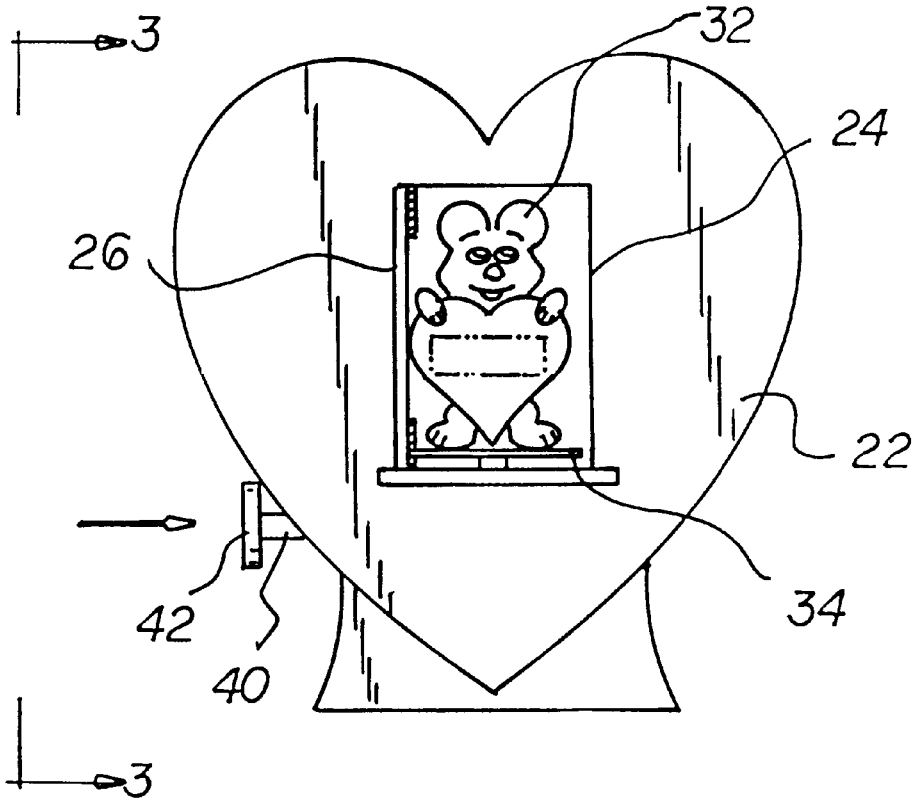
FIG. 2 is a front view of the present invention illustrated in the pop-out orientation.

With reference now to the drawings, and in particular, to FIGS. 1 through 4 thereof, the preferred embodiment of the new and improved pop-out toy embodying the principles and concepts of the present invention and generally designated by the reference number 10 will be described.

Specifically, it will be noted in the various Figures that the device relates to a pop-out toy for popping a figure out of a doorway via manual operation. In its broadest context, the device consists of a housing, a figurine, and a release mechanism. Such components are individually configured and correlated with respect to each other so as to attain the desired objective.

The housing 12 has a generally rectangular configuration. The housing 12 is defined by a top wall 14, a bottom wall 16, a rear wall 18, opposed side walls 20, and an enlarged front wall 22. In the preferred embodiment, the front wall 22 is formed in the shape of a heart. The front wall 22 has a width about twice as great as a width of the rear wall 18. The front wall 22 has an opening 24 through a central portion thereof. The opening 24 has a door 26 pivotally disposed therein. The door 26 is constructed to freely open and close with pressure. The bottom wall 16 has a pair of support posts 28 extending upwardly from an inner surface interiorly of the housing 12. The bottom wall 16 has a gear 30 mounted on a rod extending upwardly from the inner surface interiorly of the housing 12.

The figurine 32 is mounted on a platform 34 positioned within the opening 24 in the front wall 22 of the housing 12. The figurine 32, in the preferred embodiment, is represented by an animated bear. The figurine 32 is holding a sign with indicia disposed thereon to signify a certain message or the like. The platform 34 is secured to a support rod 36 extending rearwardly therefrom interiorly of the housing 12. The support rod 36 extends between the pair of support posts 28. The support rod 36 has teeth 38 extending along a side edge thereof. The teeth 38 engage an upper portion of the gear 30.

The release mechanism is comprised of a handle 40 extending inwardly of one of the opposed side walls 20 of the housing 12 interiorly thereof. The handle 40 has a manipulation knob 42 disposed on an outer end thereof. The handle 40 has teeth 44 disposed along a side edge thereof. The teeth 44 engage a lower portion of the gear 30. An inner portion of the handle 40 has a post 46 extending rearwardly therefrom. The post 46 has a spring 48 secured thereto. A free end of the spring 48 secures to the side wall 20 where the handle 40 extended through into the housing 12. The spring 48 biases the handle 40 outwardly with respect to the housing 12.

In use, the user simply pushes inwardly on the handle 40 by using the manipulation knob 42. This will cause the teeth 44 on the handle 40 to rotate the gear 30 which in turn will engage the teeth 38 of the support rod 36 thereby causing support rod to move outwardly, thus causing the figurine 32 to push through the door 26 and out the opening 24. By releasing the handle 40, the spring 48 will return the handle 40 to it's start position thereby returning the figurine 32 interiorly of the housing 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the united states is as follows:

1. A pop-out toy for popping a figure out of a doorway via manual operation comprising, in combination:

a housing having a generally rectangular configuration, the housing being defined by a top wall, a bottom wall, a rear wall, opposed side walls, and an enlarged front wall, the front wall having a width about twice as great as a width of the rear wall, the front wall having an opening through a central portion thereof, the opening having a door pivotally disposed therein, the bottom wall having a pair of support posts extending upwardly from an inner surface interiorly of the housing, the bottom wall having a gear mounted on a rod extending upwardly from the inner surface interiorly of the housing;

a figurine mounted on a platform positioned within the opening in the front wall of the housing, the platform being secured to a support rod extending towards and into the interior of the housing in a generally horizontal direction, the support rod extending between the pair of support posts, the support rod having a teeth extending along a side edge thereof, the teeth engaging an upper portion of the gear;

a release mechanism comprised of a handle extending through an opening in one of the opposed side walls of the housing, the handle having a manipulation knob disposed on an outer end thereof, the handle having teeth disposed along a side edge thereof, the teeth engaging a lower portion of the gear, an inner portion of the handle having a post extending rearwardly therefrom, the post having a spring secured thereto, a free end of the spring securing to the side wall where the handle extended through into the housing, the spring biasing the handle outwardly with respect to the housing.

2. A pop-out toy for popping a figure out of a doorway via manual operation comprising, in combination:

a housing having an opening through a central portion thereof, a bottom wall of the housing having a gear mounted on a rod extending upwardly from the inner surface interiorly of the housing, said opening having a door pivotally disposed therein;

a figurine mounted on a platform positioned within the opening in the housing, the platform being secured to a support rod extending from the opening, towards and into the interior of the housing in a generally horizontal direction, the support rod having a teeth extending along a side edge thereof, the teeth engaging an upper portion of the gear;

a release mechanism comprised of a handle extending through an opening in one of the opposed side walls of the housing, the handle having teeth disposed along a side edge thereof, the teeth engaging a lower portion of the gear.

3. A pop-out toy for popping a figure out of a doorway via manual operation comprising, in combination:

a housing having an opening through a central portion thereof, a bottom wall of the housing having a gear mounted on a rod extending upwardly from the inner surface interiorly of the housing, said bottom wall having a pair of support posts extending upwardly from an inner surface interiorly thereof for receiving the support rod of the figurine therebetween;

a figurine mounted on a platform positioned within the opening in the housing, the platform being secured to a support rod extending from the opening, towards and into the interior of the housing in a generally horizontal direction, the support rod having a teeth extending along a side edge thereof, the teeth engaging an upper portion of the gear;

a release mechanism comprised of a handle extending through an opening in one of the opposed side walls of the housing, the handle having teeth disposed along a side edge thereof, the teeth engaging a lower portion of the gear.

4. A pop-out toy for popping a figure out of a doorway via manual operation comprising, in combination:

a housing having an opening through a central portion thereof, a bottom wall of the housing having a gear mounted on a rod extending upwardly from the inner surface interiorly of the housing;

a figurine mounted on a platform positioned within the opening in the housing, the platform being secured to a support rod extending from the opening, towards and into the interior of the housing in a generally horizontal direction, the support rod having a teeth extending along a side edge thereof, the teeth engaging an upper portion of the gear;

a release mechanism comprised of a handle extending through an opening in one of the opposed side walls of the housing, the handle having teeth disposed along a side edge thereof, the teeth engaging a lower portion of the gear, wherein an inner portion of the handle has a post extending rearwardly therefrom, the post having a spring secured thereto, a free end of the spring secured to the side wall where the handle extends through into the housing, the spring biasing the handle outwardly with respect to the housing.

* * * * *